United States Patent [19]

Rich et al.

[11] 3,934,215

[45] Jan. 20, 1976

[54] SWITCH MECHANISMS

[75] Inventors: Donald S. Rich, Flanders; Norman Rudnick, Piscataway, both of N.J.

[73] Assignee: Inflo Systems, Inc., Chester, N.J.

[22] Filed: May 28, 1974

[21] Appl. No.: 474,038

[52] U.S. Cl. ..... 335/207; 200/67 F; 335/188

[51] Int. Cl.[2] ..... H01H 5/02

[58] Field of Search ..... 335/49, 50, 51, 52, 53, 335/55, 56, 207, 306, 188; 200/191, 195, 175, 209, 214, 67 F

[56] References Cited

UNITED STATES PATENTS

| | | | |
|---|---|---|---|
| 3,486,144 | 12/1969 | Paige | 200/67 F |
| 3,644,855 | 2/1972 | Cherry et al. | 200/67 F |
| 3,815,066 | 6/1974 | Vinal | 200/67 F |

OTHER PUBLICATIONS

IBM Technical Disclosure Bullentin, Vol. 15, No. 9, Feb. 1973, "Magnetic Actuator Key Mechanism".

*Primary Examiner*—Harold Broome
*Attorney, Agent, or Firm*—Philip Furgang

[57] ABSTRACT

Disclosed is a switch housing having a cylindrically shaped cavity therein. An armature within the housing has a generally cylindrical shape and is movable with respect to the housing between two stable or quiescent positions. One end of the armature has a substantially hemispherical depression and forms, in combination with a matching depression in the base, a substantially spheroid portion of a chamber. Extending radially from the segment of the sphere within the base are two frusto-pyramidal depressions which extend downwardly to and in tangency with the spheroid segment in the base. Electrical conductors are adjacent the frusto ends of the pyramids and extend out of the base. Mercury is placed in the spheroid portion of the chamber. The armature has a collar of steel extending axially. A toroidal magnet is placed about the exterior of the cylindrical housing. A magnetically responsive keeper is secured to the housing top. The magnet is held by the metal keeper secured to the top of the housing. Pressure upon the magnet causes it to move downwardly resulting in the downward movement of the armature. The armature displaces part of the mercury into the pyramidal portions of the chamber. Thus, with the armature in the lowermost or second quiescent position, the mercury extends from one extension, through the base depression to the other extension thereby completing electrical continuity between the contacts.

A push-button is secured to the toroidal magnet such that a predetermined force is required to remove the magnet from the keeper. The resulting force necessary to remove the magnet from the keeper imparts the sensation of tactile breakthrough.

6 Claims, 15 Drawing Figures

SWITCH MECHANISMS

BACKGROUND OF THE INVENTION

This invention relates to switches and more particularly to electrical switches.

In one aspect of this invention, a push-button or key operation is provided which stimulates tactile breakthrough. The term "tactile breakthrough" is applied to the feeling of release or free movement of a mechanical key or push-button imparted to the operator after a predetermined point in the pressing of the key is reached. Generally, this feeling is realized when the operated key or push-button has finished or is certain to finish its task. For example, when a typewriter key is pushed to the point where the alphanumeric holding arm is thrown against the platen, the remaining motion of the key is made with far less force — hence, tactile breakthrough. The free movement tells the operator that the task has been completed.

Tests made under scientifically controlled conditions, have shown a marked difference in operational performance between those push-buttons which exhibit tactile breakthrough and those that do not. Fewer errors and greater speed of operation are exhibited on tactile breakthrough push-buttons. In these days, more and more electronic push-buttons are being employed to operate such devices as typewriters, calculators, cash registers, telephones, and the like. These push-buttons, rather than manually operated keys having mechanical linkages, are becoming a greater part of industry. It, therefore, becomes increasingly important that such electronic push-buttons operate accurately and at high speed. The need for greater accuracy and speed has necessitated the development of electronic push-buttons which simulate tactile breakthrough.

It is believed that present push-buttons which attempt to simulate tactile breakthrough are of a complicated construction, usually involving a combination of springs or similar means. Such devices are believed to be expensive and have a limited life. The complexities of some of these devices are believed to also result in increased expense of maintenance.

A switch which exhibits a tactile breakthrough characteristic may have, in accordance with the invention discussed hereinafter, any form of overall construction. One type of construction, however, is the switch which operates in response to a magnetic field.

Switches employing a liquid conductor as a throw are well known. Of these switches, there have been proposed a number of switches which seek to distort or displace a liquid conductor to thereby couple electrical contacts and to use the self-restorative forces of such liquid conductors to uncouple the electrical contacts. One such device is proposed by Donald S. Rich (one of the co-inventors herein) in an application for United States Letters Patent for SWITCHES, Ser. No. 345,358, and filed Mar. 27, 1973. Other devices are proposed by Schmid in U.S. Pat. No. 3,358,109, Lanctot in U.S. Pat. No. 3,184,693, and Ubukata et al. in U.S. Pat. No. 3,377,445.

Each of these devices has in common the moving of mercury within confined spaces so as to control its flow, thereby forming a fluid throw. The aforementioned patent by Schmid proposes, in one embodiment, a plate made of insulating material having recesses therein. Within the recesses are the exposed ends of electrical contacts. Droplets of mercury fill the remainder of the recesses. Centrally disposed between the two recesses is a third recess larger than the other two and having a larger pool of mercury therein. The insulating plate is covered with a second insulating plate which encloses each of the recesses and forms a capillary path between each of the recesses communicating with the third recess. The top insulating plate has an aperture with a membrane thereacross by which means pressure may be placed upon the larger droplet of mercury in the third recess. By placing pressure on the third droplet of mercury by depressing the membrane, Schmid proposes that the mercury traveled through the capillaries to join with the other two droplets thereby completing an electrical contact. The capillary channels, however, are, in effect, enclosed tunnels. Schmid teaches no means of venting the gases as the gases flow into the capillary channels. The gases therein must be compressed. Such compressed gases would, it is believed, resist the advance of mercury thereby retarding or defeating the action of the switch.

The device of Schmid also has a further disadvantage. Mercury under heavy handling or vigorous actuation tends to subdivide into tiny droplets which become dispersed into all available voids. In addition, sustained pressure may promote adhesion of the mercury to the walls of the channels, thereby delaying or even preventing the retreating of the mercury upon the removal of the switching pressure. If the mercury is thus inhibited in its motion, the breaking of electrical contact will lag significantly behind the switching action or not take place at all. What is more, the device as taught by Schmid provides that the capillary connecting tubes or channels should have a smooth surface. A smooth surface would work against proper operation. Indeed it is believed that it is well known that a fine roughening of the surface is preferred and often referred to as "alacritizing" by those experienced in the art.

The device disclosed by Lanctot, in his aforementioned patent, like that disclosed by Schmid employs the use of a flexible diaphragm to distort a droplet of mercury. Lanctot's purpose, however, is to fill a gap in a high frequency strip line so that electric current will encounter a minimum discontinuity in passing therethrough. The transmission line characteristics require that the geometry of the liquid conductive path that bridges the gap during switching match closely that of the members it is joining. By depressing the membrane or diaphragm, Lanctot proposes to compress a mercury pool to fill a cavity of a predetermined shape bounded at both ends by the interrupted edges of the strip line. Like Schmid, Lanctot provides no means of venting as the mercury is forced into the sharp rectangular corners formed by the strip line. Lanctot's purpose is to form a coordinated strip line mercury switch rather than a switch, such as that proposed by Schmid, that would be insensitive to the pull of gravity.

Ubukata et al. teaches a time delay switch which is clearly position-sensitive and requires a movable container within a container. The inner container has a hole in the bottom and is disposed in the confined pool of mercury in the outer container. The mercury is permitted to flow into and out of the inner container through a conduit having angularly disposed side walls which permits the mercury to flow unrestricted by the movement of gases within the switch. When the inner container is lifted out of the pool of mercury, it brings with it a portion of the mercury which then flows slowly from the second container back into the first container, thereby forming the time delay. Ubukata et al. device is clearly position-sensitive and is ill suited for a quick response as that proposed herein or suggested in the aforementioned Rich application.

Thus, the prior art devices exhibit certain disadvantages. The flow of mercury or another liquid conductor is achieved only at the expense of either being position-sensitive (Lanctot) or work against gases compressed by the flow of the liquid conductor (Schmid and Lanctot).

The aforementioned Rich application proposes a switch intended to overcome the deficiency of the prior art by providing a position insensitive liquid state switch having a plunger for displacing the liquid from a pool into a restricted passage-way. The passage-way is defined by the plunger and a side wall of the cavity. The surface tension of the liquid is used to inhibit its entrance into the passage-way.

Clearly, the narrower opening from the liquid pool into the passage-way, the more likely it is that the liquid conductor will, due to the forces of its surface tension, be restrained from entering therein. On the other hand, the opening must be large enough to permit the forces exerted upon the plunger to overcome this surface tension so that the liquid will be displaced into the passage-way when it is desired to operate the switch. Converging walls of the plunger and the cavity are employed to encourage the self-propelled removal of the displaced liquid from the passage-way when the plunger is withdrawn from the liquid pool. This requirement provides additional parameters to the design of the switch. The electrical contact in the cavity wall should be as far removed from the liquid pool as possible so that any shock or vibrational forces will not so deform the liquid as to cause it to enter the passageway and prematurely couple the contacts and "misfire" the switch. Preferably such a contact should also be located at or near the apex of the converging walls so that it is much more difficult for prematurely displaced liquid to reach the contact and couple it to the pool. On the other hand, this position is limited by the lowermost position of the plunger — since the contact must remain in the passageway. However, the result is that with the plunger fully withdrawn, the contact is now spaced a greater distance from the wall of the plunger and is therefore in a more open or accessible position in the passageway. The resulting spacing has been observed to leave the contact vulnerable to premature coupling under displacement of the liquid due to shock and vibration. Further, it has been observed that the flow of the liquid up into the passageway is in a direction substantially opposed to the downward direction of movement of the plunger displacing the liquid. Thus, by the resolution of forces, it is believed that the net force available by the plunger is thereby reduced. This loss due to the counterforces of the liquid upon the plunger makes the plunger less efficient. The force available is a function of both the magnetic coupling, from the exterior of the push-button to the plunger and the plunger's mass. Because of the decreased effective forces the entrance into the passageway must be correspondingly larger. The resulting compromises in construction are believed to leave such a switch vulnerable to premature closing due to the shock or vibrational forces.

A further limitation is found in the variations in the dimension of the passageway with respect to the contact as the plunger is withdrawn from the pool. To ensure good "making," wetted contacts are used. However, such wetted contacts tend to hold onto the liquid conductor. Thus, it is desired that the liquid conductor self-propel itself from the passageway. It is for this reason that the passageway is provided with converging walls. As the liquid conductor propels itself from the passageway it "necks down" and eventually breaks with the wetted contact. It is desirable that this breaking should be as soon as possible. As the plunger is withdrawn, however, the space between the contact wall and the plunger wall becomes increasingly larger, thereby providing a wider path for the flow of the liquid back to the pool. The withdrawing wall also increases the dimensions of the passageway at a time when it is desired to either keep such dimensions constant or, at best, narrower to encourage the self-removal of the liquid and the breaking of the liquid thread. The widening passageway encourages a thicker thread, thereby slowing down breaking off of the contact between the pool and the wetted contact.

SUMMARY OF THE INVENTION

An object of this invention is to provide means for operating an electrical switch which simulates the "tactile breakthrough" of mechanically linked keys.

A further object of this invention is to provide a means for operating an electrical switch which simulates tactile breakthrough and which is simple in construction and economical in manufacture.

An object of this invention is to provide a liquid conductor switch which will operate and be substantially insensitive to the forces of shock and vibration and orientation.

It is still another object of this invention to provide a switch which exhibits bounce-free characteristics.

It is a further object of this invention to provide a liquid conductive switch which efficiently employs a minimum number of parts, is economical to manufacture and simple and efficient in use.

In accordance with the teachings of this invention, there is provided a housing having therein a cavity. An armature means is within the cavity and defines, with the cavity walls, a chamber. The chamber comprises constant and variable volume portions. The constant volume portion comprises container-like walls substantially fixed with respect to one another. A liquid conductor is in the variable volume portion. The constant volume portion is joined to the variable volume portion. The constant volume portion is joined to the variable volume portion at a common port. The port is capable of passing the liquid conductor upon the liquid conductor being displaced from the variable volume portion by the armature means. The armature means moves with respect to the housing and that movement determines the volume of the variable volume portion. The constant volume portion is defined by at least three intersecting planes converging away from the port. Upon the armature means being removed from the displacing of the liquid conductor, the walls of the constant volume portion, defined by the intersecting planes, acts upon the liquid conductor to urge the liquid conductor from the constant volume portion through the port and into the variable volume portion. Electrical contacts communicate from without the housing and into the chambers. The conductive liquid in another of the armature means in one of its positions causes the liquid conductor to electrically couple the electrical contacts. The conductive liquid in another of the armature means quiescent positions uncouples the electrical contacts. There is also provided means for moving the armature means to operate the switch.

In another aspect of the invention, there is a switch means which comprises a housing having therein a fully enclosed cavity. An armature means is within the cavity and movable with respect thereto and defines in combination with the cavity walls a chamber. The chamber comprises conjoined, constant, and variable volume portions, the constant volume portion being a container-like structure with constant dimension for receiving therewithin the liquid conductor through a port between the fixed and variable volume portions. The relative position of the armature means within the cavity determines the volume of the variable volume portion. A liquid conductor within the variable volume portion of the chamber occupies the constant volume portion in dependence upon the relative position of the armature means. A gas is within the cavity. Means are provided for venting the gas from the constant volume portion of the chamber, the gas being displaced by the liquid conductor which is in turn displaced by the armature means. Electrical contacts are provided which communicate within from without the housing into the chamber. The conductive liquid in one of the armature means quiescent positions electrically couples the electrical contacts. The conductive liquid in still another position of the armature means uncouples the electrical contacts. There is further provided means for moving the plunger from one of the positions to another of the positions.

In still another aspect of this invention, there is provided a push-button operating means for operating a magnetically responsive switch mechanism. This push-button operating means comprises means for housing the switch mechanism. Magnetic means are provided and disposed for relative movement with respect to the housing such that the movement so provides magnetic flux to cause the operation of the switch mechanism. Keeper means are provided for holding the magnetic means in a first quiescent position. Push-button means are provided for moving the magnetic means from the keeper with a predetermined initial force, the initial force being greater than that force necessary to the continued movement of the magnetic means with respect to the switch housing, thereby simulating tactile breakthrough and stop means are provided for limiting the travel of the magnetic means.

The novel features of the present invention, both as to its organization and methods of operation, as well as additional objects and advantages thereof, will be more readily understood from the following description, when read in connection with the accompanying drawing, in which similar reference numbers refer to similar components and prime reference numbers refer to components serving a similar function or structure as components in other figures and in which:

DESCRIPTION OF THE PREFERRED EMBODIMENTS

Figure 1:
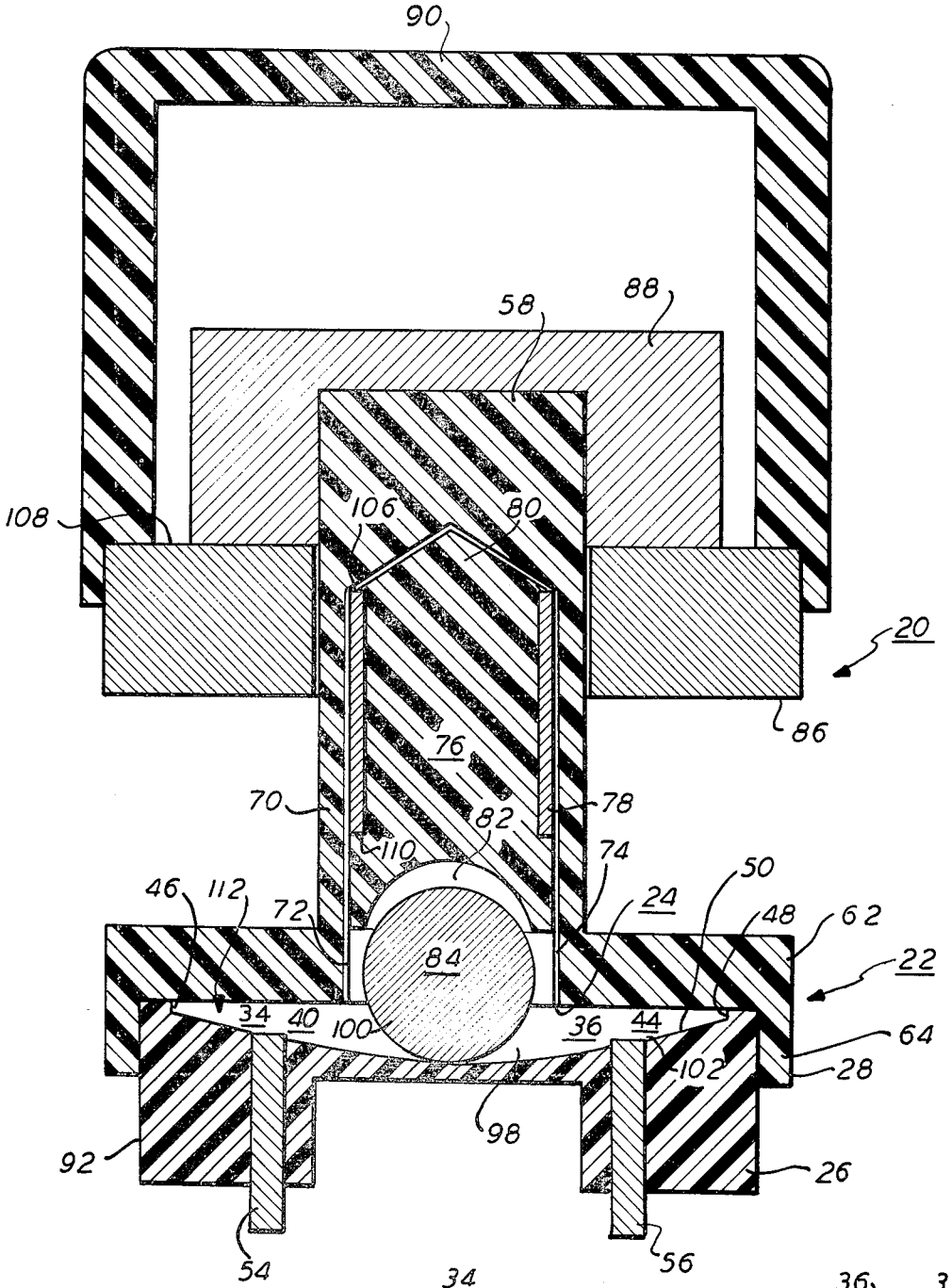
FIG. 1 is a sectional plan view of a switch and switch operating mechanism constructed in accordance with the teachings of this invention and showing an armature in a first quiescent position.

Turning now to the drawing, there is disclosed in FIGS. 1–8 a switch 20 and components thereof. The switch 20 may comprise a housing 22. The housing 22 encloses therewithin a cavity 24. The housing 22 may comprise two parts; a base 26 and a top 28. The housing 22 may be made of any rigid insulating material, of low magnetic impermeability. Thus, for example, the housing 22 may be made of plastic or glass.

The base 26 (FIGS. 1, 2, 5–7) may have, for example, a generally disk-like shape. Within the upper surface 30 of the base 26 and centrally disposed may be a depression 32. The depression 32 may be in the shape of a segment of a sphere substantially close to that of a hemisphere. Thus, the depression 32 is preferably smaller than a true hemisphere.

Figure 7:
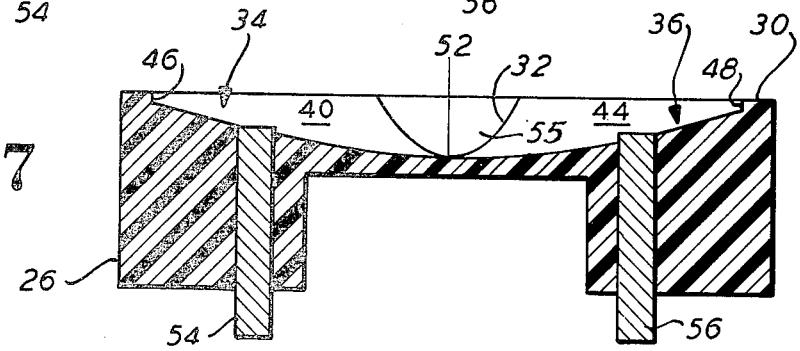
FIG. 7 is a sectional view of the base of FIG. 5 taken along the lines 7—7.
Figure 5:
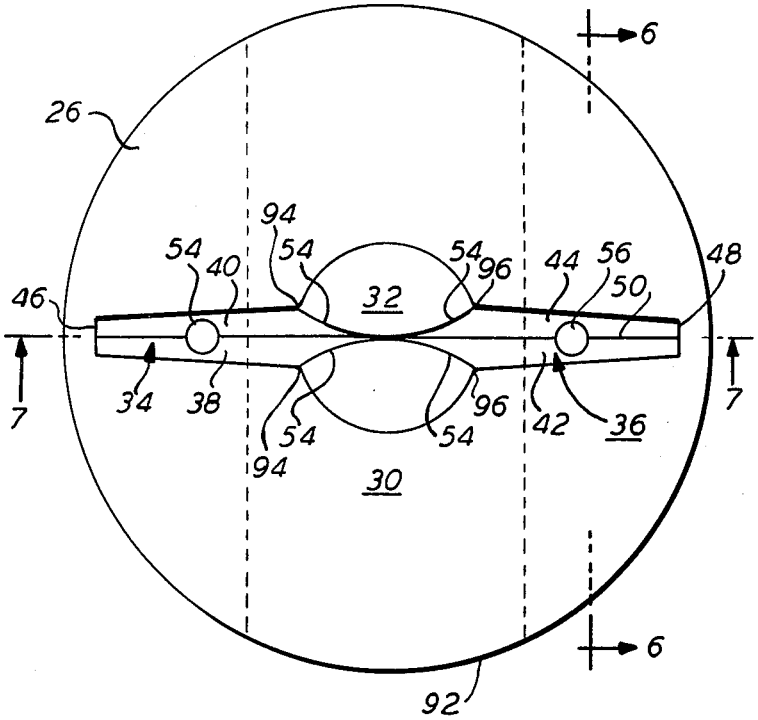
FIG. 5 is a top view of the base of the housing of FIG. 1.

Extending radially from the depression 32 may be channels 34 and 36. The channels 34 and 36 take the form of polygonal cuts or indentations within the upper surface 30 of the disk-shaped base 26. Preferably the polygonal shape of the channels 34 and 36 takes the form of frusto-pyramidal indentations with two sides 38 and 40 of a first channel 34 and two sides 42 and 44 of the other channel 36 defining two sides of the frusto-pyramidal indentation. The frusto ends 46 and 48 of the channels 34 and 36 terminate at a point away from the segment depression 32. As seen from the top (FIG. 5) the intersection of the sides 38 and 40 of the first channel 34 and the sides 42 and 44 of the second channel 36 form in the top view a straight line 50 (FIG. 5) which extends radially through the substantially hemispheric depression 32. This line 50 extends from the frusto ends 46 and 48 into the base 26 and is tangent at the lowermost point 52 of the depression 32 (FIG. 7). The channels 34 and 36 extend into the base 26 intersecting the substantially hemispherical depression 32, thereby resulting in arced intersections 54 with the substantially hemispherical depression 32 (FIGS. 5 and 7). The side walls 38, 40, 42, and 44 of the channels 34 and 36 may form between them any suitable angle which, for example, may be 60°.

Extending vertically through the base 26 may be a pair of electrical contacts 54 and 56. Each of the contacts 54 and 56 extends into a respective one of the channels 34 and 36 adjacent to, but spaced from the frusto ends 46 and 48, respectively, of the channels 34 and 36. The contacts 54 and 56 are preferably flush with the sides 38, 40, 42, and 44 of the channels 34 and 36 and have the exposed ends thereof of a wettable material (i.e., wettable by the liquid conductor in the switch).

Turning now to the top 28 (FIGS. 1–4), this portion of the housing 22 takes the form of an inverted cylindrical cup with the closed end 58 uppermost. The open end 60 is provided with a radially extending flange 62 which terminates in a downwardly extending lip 64. As previously indicated, the top 28 forms an inverted cylindrical cup. The closed end of the cup internally may comprise a conical depression 66. In the alternative, this closed end may assume any other convenient shape, for example, a flat radial plane (not shown). The function of this conical depression 56 will be more fully discussed hereinbelow. Extending parallel the axis of the cylindrical portion 68 of the top 28 within the side walls 70 thereof may be formed two slots or passageways 72 and 74. The functions of these two slots or passageways 72 and 74 will be more fully discussed below.

Figure 2:
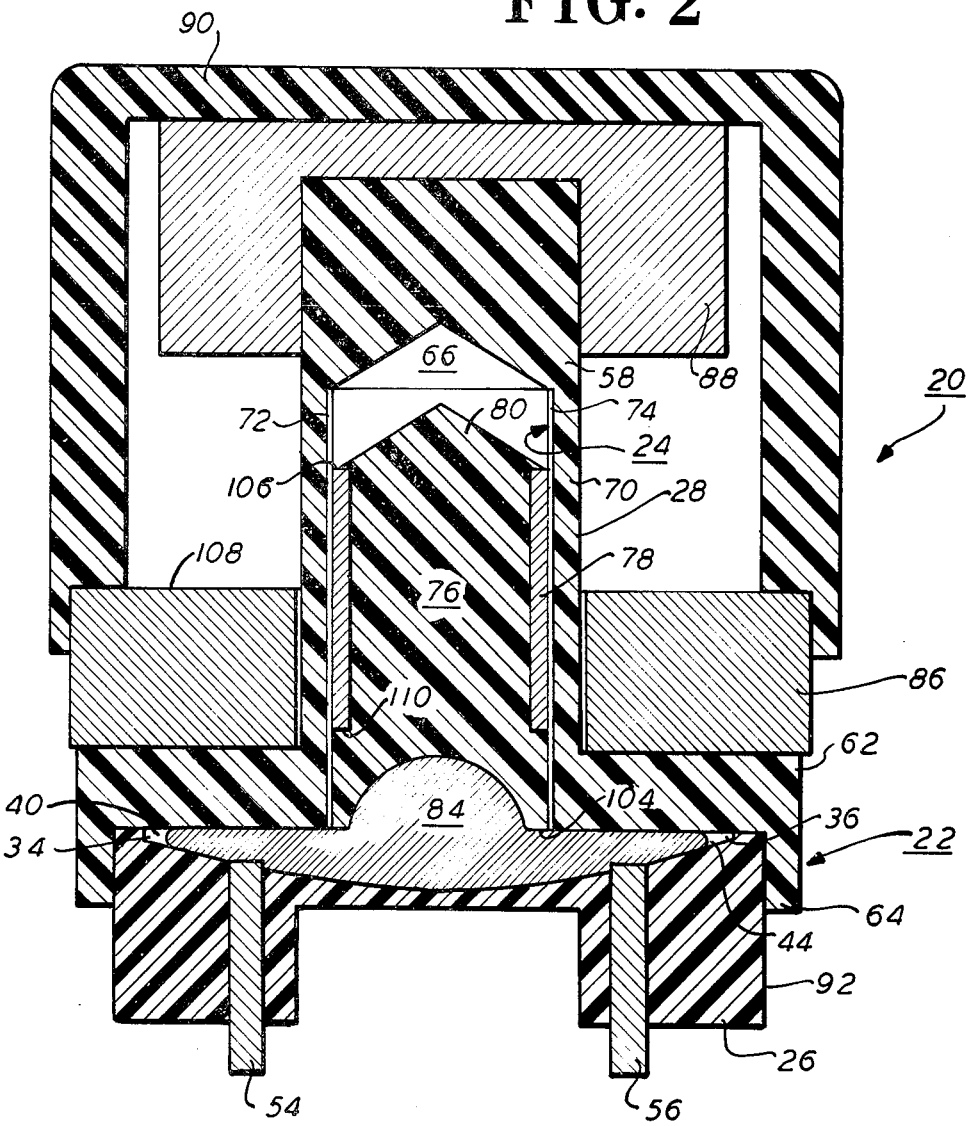
FIG. 2 is a sectional plan view of the switch of FIG. 1 with the armature in a second position.
Figure 8:
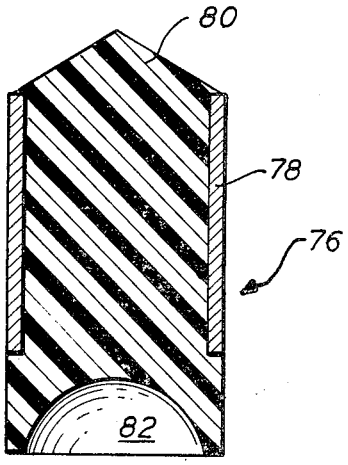
FIG. 8 is a sectional plan view of the armature of the switch of FIG. 1.

Within the cylindrical portion 68 of the top 28 may be an armature means 76 (FIGS. 1, 2, and 8). The armature may take the form of any conductive or nonconductive material. Preferably, in order to assure ease in manufacture, the armature may be made of any well known plastic material which will not react with a liquid conductor as shall be more fully explained hereinafter. The armature 76 may have a generally cylindrical shape and conform to generally cylindrical portion 68 of the top 28 so as to move freely therewithin. Intergral therewith and forming a part thereof may be a metallic magnetically responsive collar 78 which may extend along a substantial axial length of the armature 76. The uppermost portion of the armature 78 terminates in a cone 80 which is intended to be in registry with the conical depression 66 of the closed end 58 of the top 28. The function of the conical end 80 of the armature 76 will be more fully discussed hereinafter. The axial bottom of the armature 76 may have therein a depression 82 substantially in the form of a segment of a sphere. Thus, preferably the depression 82 may approximate but be somewhat less than a hemisphere.

Upon the base may be disposed a quantity of a liquid conductor which may be preferably mercury 84 (FIGS. 1 and 2).

Disposed about the side walls 70, which enclose the cylindrical portion 68 of the top 28, may be a magnet intended to exert magnetic flux upon the armature 76. Thus, such a magnet 86 (FIGS. 1 and 2) may take the form of a toroidal magnet 86.

Secured to the closed end 58 of the top 28 may be a discoid 88 having therein a central depression so as to engage the top 28. This discoid 88 may be made of any magnetically responsive material such as, for example, a ferro-magnetic material such as steel. The discoid 88 serves as a keeper, a function that will be more fully discussed below, and is secured to the top 28 by a snug fit. The diameter of the discoid keeper 88 is substantially less than that of the magnet 86. Secured to the magnet 86 and enclosing the keeper 88 may be a push-button 90.

In assembly, the base 26 is inserted within the lip 64. The lip is spaced so as to firmly engage the sides 92 of the base 26. The radial flange 62 encloses with a planar upper surface 30 of the base 26, enclosing the channels 34 and 36. The slots 72 and 74 are so disposed and dimensioned (FIG. 4) as to be in registry with the widest arc 94 and 96 respectively at the intersection of the channels 34 and 36 with the substantially hemispheric depression 32 (FIG. 5).

The magnet 86 is about the housing top 28 with the keeper 88 secured in place and the push-button 90 secured thereabout to the magnet 86.

It will be observed that unlike prior art devices, no special orientation is required for the armature 76.

Certain physical principles are exploited in the special features of the present invention. Thus, the force of surface tension is known to act tangentially to the surface of a free liquid to confine that pliant body as if within a skin-like envelope. The shape thus assumed by a drop of liquid represents a condition of minimum energy consistent with the forces acting upon it. In the absence of all external forces, such as gravity or compressing walls, only the surface tension affects the liquid and the liquid would thereby assume a sphere. A drop of liquid placed on a planar surface that it does not wet becomes somewhat flattened by the unidirectional pull of gravity. Since the surface tension is dependent upon the area affected and the force of gravity is proportional to the mass or volume of the liquid, it follows that the smaller the drop, the more closely spherical it will be. To deform the droplet from a natural shape requires externally applied pressure against the opposition of the surface tension. Two special conditions are employed in the present invention.

First, a droplet of high surface tension is made very small so that the forces of gravity are reduced to an almost negligible significance compared with the forces of surface tension. The resulting droplet is almost perfectly spherical. Thus, in the preferred embodiment presented, the mercury 84 assumes a spherical shape which is in turn reinforced by placing the mercury 84 in a spherical cavity having the natural diameter of the droplet. During switching action, the droplet of mercury 84 is compressed (FIG. 2) forcing a portion of the droplet to extrude through ports 55 in the substantially hemispherical depression 32. The movement of such small portions of mercury 84 should occur only during deliberate actuation of the switch 20 and not from gravity or the random agitation of vibration and shock. It is also desired that the droplet not subdivide and disperse on suffering mechanical shock or vibration. The achievement of these objectives is derived from the smallness of the droplet, its close confinement in the spherical portion and the narrowness of the ports 52 into the extensions 34 and 36. It is believed that a substantial force is needed to deform the droplet of mercury 84 through such constricted openings 55. This force is available by design from the normal push-button pressure of the switch operation but is not available from other sources. Thus, the mass-acceleration forces generated by vibration are minimized due to small mass contribution of the armature 76, mercury 84. The momentum gathered by the droplet of mercury 84 from such acceleration is low because there is little room for the displacement required to pick up speed and hence little energy upon impact with the surroundings. Lastly, there is a spherical cavity wall to promote the retention of the droplet integrity.

The second condition is directed to the behavior of the mercury droplet 84 and its behavior in passages or tunnels whose walls it does not wet and whose cross-sections are smaller than the natural diameter of the free droplet. If a droplet of mercury is confined in an open-ended tube of small constant inner circular diameter, the droplet is caused to elongate. It will do so equally in both available directions. If the tube is changed to a cone of a small acute angle, the droplet will be forced away from the apex toward regions of greater diameter. If the cone is now changed to a pyramid or polygonal cross-section, similar movement away from the apex will be observed with an additional feature of great significance to the present invention. The droplet will be flattened somewhat against the planar walls of the pyramid but it will not fill the sharp corners where the walls intersect. If the droplet is pressed by some means toward the apex of the pyramid, it will tend to penetrate more deeply into the corners but the ever-increasing resistance of surface tension will demand inordinately larger external forces to produce slight gains in this respect. In the present invention, these phenomena are employed in two ways. The droplet 84 is so pressed toward the frusto ends 46 and 48 of the small pyramidal channels 34 and 36 in the course of switch closure. Furthermore, the advancing liquid displaces gases occupying the pyramidal channels 34 and 36. If these cannot escape, they threaten to block entry of the liquid. This most frequently happens in constant diameter smooth-walled capillaries. The open passages along the corners at the wall intersections provide the required vent path for reasons discussed above. When the switch is opened, the converging walls of the pyramidal extensions 34 and 36 cause the droplet to withdraw from the apex promptly.

Description of the characteristic behavior of nonwetting drops of liquid such as mercury between intersecting planes or within cones can be found in various texts. In particular, "Elementary Treatise on Physics" by Ganot (William Withing Co., 1890), pp. 116–117.

In operation, it will be observed (FIGS. 1 and 2) that the armature 76 within the cavity 24 of the housing 22 defines in combination with the walls of the housing 22 a chamber generally indicated as 98 (FIG. 1). The chamber 98 may be considered as having a variable volume portion 100 and a constant volume portion 102. Clearly, the spherical droplet of mercury 84 occupies substantially the variable volume portion 100 of the switch 20. The movement of the armature 76 is between a raised position with its cone-like top 80 in registry with the conical depression 66 in the closed end 58 of the housing top and a second position (FIG. 2) with the outer marginal edge 104 of the substantially hemispherical depression 82 of the armature 76 abutting the upper surface 30 of the base 26 and about the substantially hemispherical depression 32 therein. Thus, the armature 76 is caused to move between a first (FIG. 1) and a second (FIG. 2) quiescent position.

The toroidal magnet 86 is so disposed as to cause the motion of the armature 76. The arrangement of the magnet is so disposed as to provide a relatively large holding force supporting the armature 76 in its two quiescent positions in order to assure firm closure and opening of the switch 20 and to protect against mechanical disturbance. The maximum force between the magnet 86 and the armature 76 occurs when the magnetically responsive portion of the armature (the collar 78) occupies between approximately 40 and 80 percent of the axial length of the magnet 86. The direction of this force is such as to attempt to draw the armature 76 further into the magnet 86 (see Standard Handbook for Electrical Engineers, A. K. Knowlton, Ed., 8th Edition, McGraw-Hill, 1949, p. 493). Thus, in operation, when the magnet 86 is in its uppermost position, abutting the keeper 88, the armature 76 is in its uppermost first quiescent position against the upper end 66 of the closed end 58 of the top 26. The topmost edge 106 of the collar 78 lies at or above the equator of the magnet 86 but well below the top surface 108 of the magnet 86. In a similar manner, when the magnet 86 is in its lowermost position (FIG. 2) held down by manual pressure on the push-button 90, the armature 76 is in its lowermost second quiescent position against the upper surface 30 of the base 26. The bottom edge 110 of the collar 78 lies at or below the equator of the magnet 86. To further enhance the holding forces and the forces causing motion of the armature 76 in response to the motion of the magnet 86, it is preferred that the axial length of the collar 78 be equal to or slightly longer than the axial length of the magnet 86.

In the first quiescent position of the armature 76, it will be noted that the depressions 32 and 82 form together a spherical chamber with a space therebetween by the portions thereof of the armature 76 and base 26 which do not complete this sphere. The droplet 84 as indicated substantially fills the spheroid portion of the variable volume portion 100 of the chamber 98. As the push-button 90 is manually depressed, the magnet 86 is pushed away from the keeper 88 and travels downward to the radial flange 62. In response thereto, the armature 76 moves from the first quiescent position (or an open switch position) to the lowermost or second quiescent position against the upper surface 30 of the base 26. The pressure of the armature 76 on the mercury 84 increases as the volume between the depressions 32 and 82 diminishes. The pressure soon overcomes the opposition of surface tension of the mercury 84 and portions of the liquid shoot off into the pyramidal channels 34 and 36 to make contact with the electrical contacts 54 and 56 respectively, thereby completing switch closure. It will be noted that portions 112 and 114 of the channels 34 and 36 are radially further outwardly from the hemispheric depression 32. These provide regions of override assuring reliable switch closure by permitting the columns of mercury 84 to pass beyond the necessary contact points. This design also permits an excess amount of mercury 84 to be used so as to avoid overly critical dimensional tolerances. With the armature 76 in the first quiescent position (FIG. 1) the cavity gas fills the channels 34 and 36. The mercury 84 entering the channels avoids the corners formed by the intersections of the walls 38, 40, 42, 44, and 62, as a result of the surface tension in maintaining a curved meniscus, as previously discussed. The sharp intersections between channel walls 38, 40, and 62, as well as 42, 44, and 62 provide escape paths along which the displaced gases can be vented harmlessly without blocking the entry of the mercury 84. Furthermore, the vent paths defined by the intersections of the sides 38 and 40 with the top or flange wall 62 as well as sides 42 and 44 and flange 62 communicate with the additional vents or pasageways 72 and 74 in the top 28. Thus, the venting gas bypasses the armature 76. As the armature 76 moves toward the second quiescent position (FIG. 2) it provides a temporary storage space for the gases at the upper end of the housing 26. These vent grooves or passageways 72 and 74 are, it should be observed, very shallow, deep enough to only pass the gas but offering a greater impedance to the entry of mercury than do the entranceways 52 into the constant volume portion 102 (channels 34 and 36) of the chamber 98. In the event that some mercury 84 should find its way into these passageways 72 and 74, the effect on the switch 20 is obviously minimal. This is because of the low probability of such an occurrence and because of the miniscule space available in the passageways 72 and 74. Furthermore, such a small amount of mercury 84 cannot totally plug the vent passageway 72 and 74 because of the essentially rectangular cross-sectional cut or form in the side wall 70. Still a further reason is that the gas flow will tend to carry such dispersed mercury 84 back to the main droplet 84, if the dispersed smaller droplet constricts the vent path or passageway 72 and 74 sufficiently to cause momentary local buildup of gas pressure.

Taken from another viewpoint, the passageways 72 and 74 and armature 76 form a pumping or recirculation system. When the armature 76 leaves the first quiescent position and compresses the mercury 84 sending offshoots of the mercury 84 into the channels 34 and 36, gas is pumped through the passageways 72 and 74 and into the region at the uppermost portion of the top 28, being vacated by the descending armature 76. Any subdroplets in the passageways 72 and 74 will be carried upward by the gas. When the armature 76 returns to its first quiescent position, its registry with the conical depression 66 will tend to pump the upper region of the top 28 free of the gas and mercury. The resultant downward flow of the gas will carry any subdroplets of mercury 84 back to the main pool 84. Any mercury that would remain would be extremely small and not have any effect upon the operation of this switch. Thus, the switch design is self-protective against dispersal of mercury, minimizing the likelihood of any dispersal, providing for means of return of dispersed subdroplets if some dispersal does take place and supplying a surplus of mercury to compensate for such minor losses as might occur under the most extreme conditions.

With the armature 76 in the second quiescent position, the push-button 90 is manually released. The keeper 88 attracts the magnet 86 upwardly which in turn pulls the armature 76 back to the first quiescent position. The surface tension pulls the mercury columns in the channels 34 and 36 back toward the depression 32 in an effort to reform a spherical body of liquid. The pyramidal geometry of the channels 34 and 36 acts to eject the mercury columns away from the respective apices, thereby aiding in the restoration to the first quiescent position. The sphericity of the variable volume portion 100 of the chamber 98 also reinforces the reformation of the spherical body of liquid. The exact compatibility between the shape of the spherical portion 100 of the chamber 98 and the natural tendency of the liquid provides a suction effect. As the armature 76 rises, the substantially hemispherical depression 82 in the armature 76 is in intimate contact with the upper surface of the mercury droplet 84, excluding gases from the area of contact. As a consequence, the depression 82 exerts a sucking force on the pliant droplet 84 as the armature 76 rises. A similar force appears between the base depression 32 and the lower surface of the mercury droplet 84. These forces, directed parallel to the axis of the switch 20, are converted hydraulically into transverse forces also providing the withdrawal of the mercury columns from the channels 34 and 36. Thus, not one but a battery of restorative forces arise when the switch 20 is returned to its first quiescent position. Withdrawal of the mercury columns from the channels 34 and 36 breaks the contacts with the electrical contacts 54 and 56, thereby opening the switch circuit.

During the withdrawal of the mercury columns from the channels 34 and 36, some retardation may be expected because of the anchoring effect of the wetted attachments of the mercury wetted contacts 54 and 56. The mercury threads between the central droplet 84 and the contacts 54 and 56 must thin and break to effect the opening of the switch circuit. To facilitate this breaking action, the contacts 54 and 56 are small in diameter and placed perpendicularly to the mercury columns to minimize the area of attachment. The outward ends of the mercury threads near the contacts 54 and 56 are necessarily smaller in cross-section than the inward ends at their connection with the main mercury droplet 84 because of the taper in the channels 34 and 36. Consequently, the threads are weakest near their outward ends. This causes the threads of mercury to break in the vicinity of the electrical contacts 54 and 56. As a result, the separation of the mercury threads is encouraged at an early stage in the cycle of the operation of the switch. The lag between the release of the push-button 90 and the breaking of the mercury thread assures a predetermined ON window. This ON window, or hysteresis effect, assures a certain minimum operation period regardless of how fast the switch 20 is operated. Alacritizing of the walls further inhibits the adhesion of the mercury to the walls or sides 38, 40, 42, 44, and 62 of the channels 34 and 36. In addition, the returning gas pumped by the armature 76 tends to add a further pressure upon the columns to urge the mercury out of the channels 34 and 36 and back into the variable portion 100 of the chamber 98.

By employing a constant volume portion 102 of the chamber 98, it is possible to locate the contacts 54 and 56 to the point as removed as possible from the central pool of mercury 84. In addition, the walls of the channels 34 and 36 may be so dimensioned as to make premature closing of the switch due to shock and vibration improbable. The venting, unlike prior art devices, makes sure of the proper passage of the mercury through such restricted passageways.

Another advantage over some of the prior art devices is the complete symmetry of the switch 20 herein. Thus, aside from the orientation of the top 28 with the bottom 26, the armature 76 requires no orientation. In addition, the armature can be made of conductive or nonconductive material. It is not necessary that the extensions be pyramidal in shape so long as venting paths are provided. In addition, the channels 34 and 36 need not be radial extensions. It will be observed that in the second quiescent position of the armature 76, a continuous path of mercury is found from one electrical contact 54 to 56. This is because the bottom of the armature abuts the uppermost portion 30 of the base leaving a large quantity of mercury 84 in the variable volume portion 100 of the chamber 98. Contacts 54 and 56 may conveniently be raised into or lowered beneath the channels 34 and 36. Indeed, the channels 34 and 36 may be formed either in a straight pyramidal form or curved as would result from cutting with a circular blade. Indeed, further polygonal shapes may be formed in the flange 62 in order to encourage further venting.

By way of example of the embodiment described above, the cylindrical portion of the top 28 may have an outer diameter of three-sixteenths of an inch and an inner diameter of approximately nine sixty-fourths of an inch. The hollow cylindrical portion 68 of the top 28 may be 0.290 of an inch in axial length. The armature 76, for example, may be 0.250 of an inch in overall axial length with diameter providing for close but freely sliding fit within the top 28. The armature 76 may thus have only 0.040 of an inch freedom of motion. The spherical droplet of mercury 84 may, for example, have a volume of 16.5 microliters with a natural radius of approximately one-sixteenth of an inch. The depressions 32 and 82 in the base 26 and armature 76 respectively may have a curvature of approximately one-sixteenth of an inch and be 0.035 of an inch in depth. Openings into the channels 34 and 36 at their intersections with the depressions 32 may be approximately equilateral triangles (partially spherical) of approximately 0.048 of an inch along each side. The channels 34 and 36 may have an overall radial length of approximately 0.140 of an inch ending in an equilateral triangle having a side length of approximately 0.012 of an inch. The passageways 72 and 74 in the top 28 may have a radial depth of 0.005 of an inch and a circumferential arc length of approximately 0.050 of an inch. These preferred dimensions are used to demonstrate the relationship between the mercury and the dimensions of the cavity so as to obtain the proper movement of the mercury within the switch 20.

As previously indicated, the constant volume portion 102 serves to locate the contacts 54 and 56 at a point in which they may operate successfully and in response to operations of the switch 20. It should also be understood that other contacts may be located in other positions within the chamber 98. For example, a contact 150 (FIG. 10) may be located within the depression 32 of the base 26. The resulting switch would be what is commonly known as a form-X switch used in telephone circuitry.

It is to be understood that the term "walls" may refer to a curved wall. Thus, the walls of the constant volume portion of the chamber might be defined by a cone. Venting might be provided by a narrow slot such as, for example, that provided in the cylindrical wall of the housing. Thus, the constant volume portion may be a cone having channels formed thereout to thereby provide a shallow polygonal cross-sectional vent channel. It should be understood that a cone is the general form of which a pyramid (as previously disclosed) is but one example. The term switch, as used herein, may be understood to apply to any electrical switch operation including relays.

Figure 9:
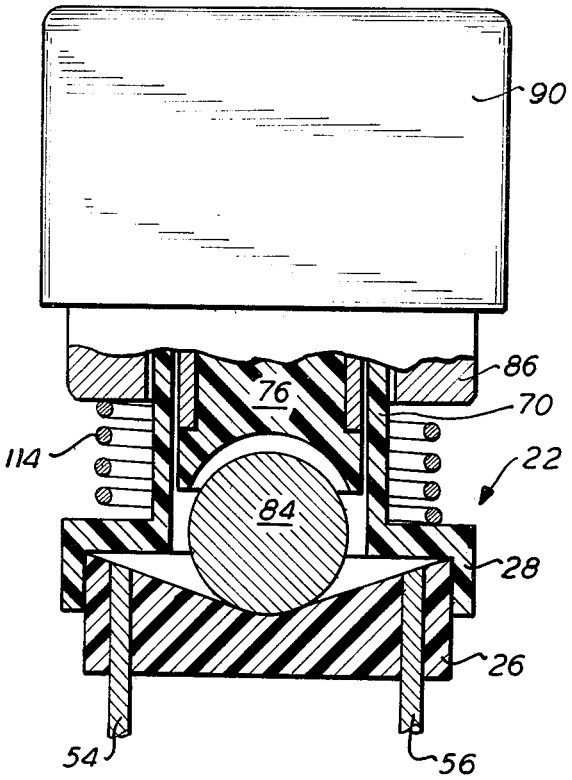
FIG. 9 is a partially sectioned plan view of a switch constructed in accordance with the teachings of this invention.
Figure 10:
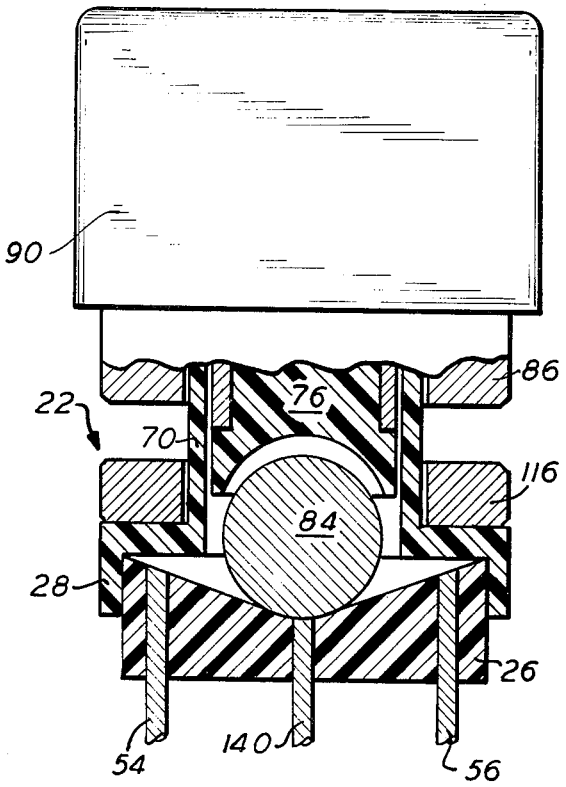
FIG. 10 is a partially sectioned plan view of still another switch constructed in accordance with the teachings of this invention.

The disclosure of the preferred embodiments, FIGS. 1 through 8 provide one means for moving the armature 76. Reference to FIGS. 9 and 10 will show two other arrangements for movement of the armature 76 in response to the motion of the magnet 86. With respect to both figures, there is disclosed a housing having a top 28 and bottom 26 and electrical contacts 54 and 56 as well as mercury 84 and armature 76 disposed as in connection with the FIGS. 1 through 8.

Disposed about the cylindrical side walls 70 on the top 28 may be helical spring 114. The push-button 90 is secured to the magnet 86. Means may be provided (not shown) secured to the housing top 28 to prevent the magnet 86 from being removed. Depression of the push-button 90 causes the magnet 86 to compress the helical spring 114. The spring is so proportioned such that the armature 76 will experience full travel upon full compression of the spring 114. In the same manner, the spring 114 is replaced by a toroidal magnet 116, oppositely poled from the magnet 86 secured to push-button 90 so that when the push-button 90 is released, the opposite poles of the magnets 86 and 116 repel each other back to the initial position. As in the case with the embodiment of FIG. 9, means (not shown) attached to the housing 22 may be provided to prevent the removal of the push-button 90 therefrom. It is clear that in the case of all of the embodiments thus far described, it is necessary that the walls of the housing 22 be thin enough to allow the magnetic flux to easily permeate therethrough to move the armature 76. Further, in the instance of the embodiment of the FIG. 10, the thickness of the magnet 116 is so dimensioned such that in the full travel position of the magnet 86, the armature 76 travels to the second quiescent position.

Figure 11:
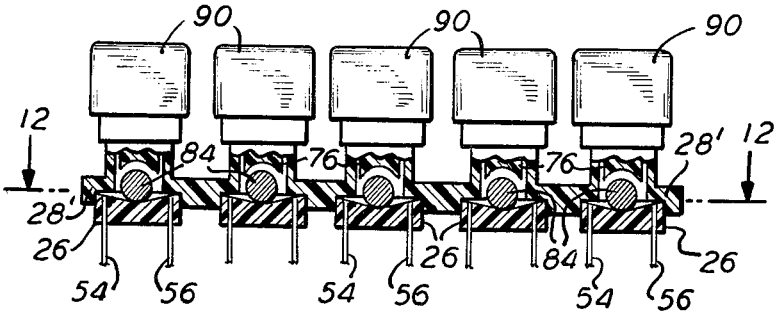
FIG. 11 is a partially sectioned plan view of a chain of switches constructed in accordance with the teachings of this invention.
Figure 12:
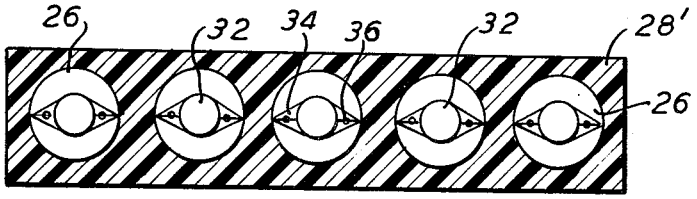
FIG. 12 is a sectional view of the base of the switches of FIG. 11 taken along the lines 12—12.

FIGS. 11 and 12 are demonstrative of one form of mass production of the switches of this invention. Thus, there may be provided a plurality of interconencted switches (FIGS. 11 and 12) in which the housing top 28' is but a series of conjoined housings disclosed hereinbefore, enclosing therewithin the mercury 84 and armature 76. Into each of the cylindrical housings 28' may be inserted a base 26 having the channels 34 and 36 and hemispherical depression 32 therewithin.

Figure 13:
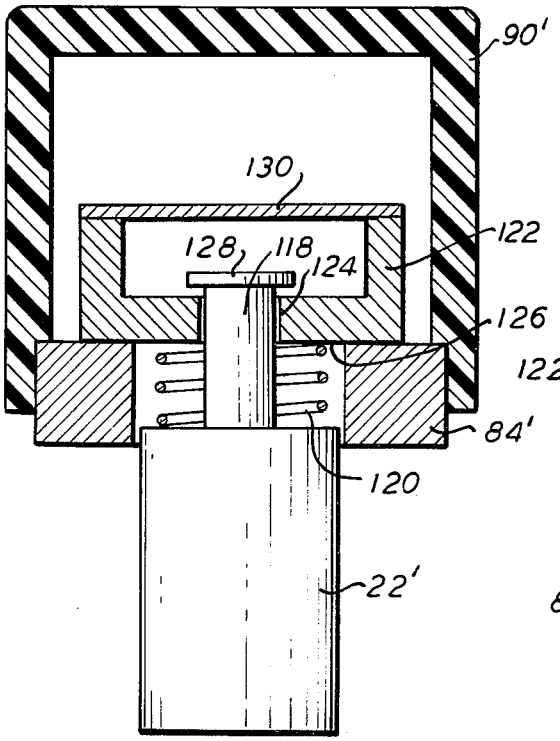
FIG. 13 is a partially sectioned schematic view of a push-button operating means of a switch constructed in accordance with the teachings of this invention showing one operating position.
Figure 14:
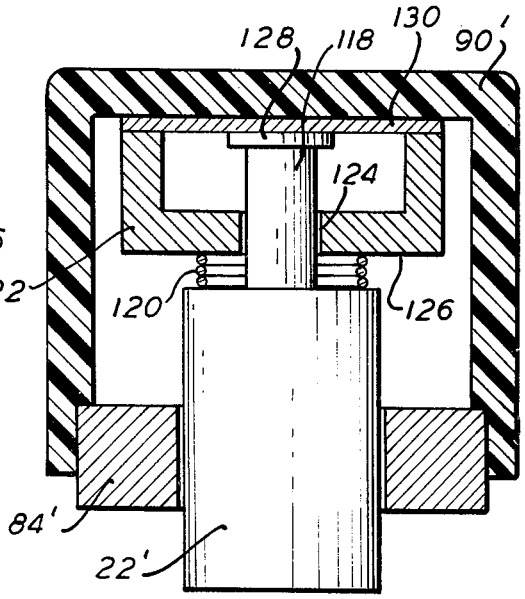
FIG. 14 is the switch of FIG. 13 showing a second operating position.

Still another construction for the operation of a switch is provided herein (FIGS. 13 and 14) and have in common therewith the similar operational characteristics of that of the switch of FIGS. 1 and 2. Thus, there is provided a switch housing 22' having a stem 118 extending axially therefrom. About the stem 118 may be a resilient means such as a helical spring 120. A toroidal magnet 84' is about the stem 124 and housing 22'. A cup-like member 122 having an aperture 124 in the bottom 126 to admit the stem 118 therethrough abuts the spring 129 and acts as a keeper to the toroidal magnet 84'. A screw 128 or other enlargement of the stem 118 may serve to hold the keeper 122 from removal from the stem 118. Within the housing 22' may be any magnetically responsive switch means. This may exist in any of the other operational means disclosed herein with respect to the other embodiments.

In operation, the push-button 90', which is secured to the toroidal magnet 84' as before, may be manually depressed. As the button 90' is depressed, the spring 120 compresses, allowing the keeper 122 to follow the push-button travel. With the spring 120 in a compressed state (FIG. 14), the magnet 84' separates from the keeper 122, immediately resulting in less force required to move the push-button 90'. The keeper 122, released from the magnet 84', is pushed upwardly by the spring 120, and clicks against the interior surface of the push-button 90'. The noise of the contact between the cup or keeper 122 and the push-button 90' delivers a sound as well as a tactile sense to the user that the operation of the switch has been completed. As the user pushes down on the push-button 90' further, the keeper 122 is then again compressed against the spring 120 by the push-button 90', thereby increasing the force necessary to push down the push-button 90'. The result of this force, less force, more force, until the push-button, 90' reaches a stop, is demonstrative of the tactile breakthrough that is well known with respect to mechanically operating keys. In this respect, reference should be made to the operation of the switch of FIGS. 1 and 2 wherein an initial force is required to separate the magnet 86 from the keeper 88, thereafter providing the user with a sense of release or less force after the magnet 86 separates from the keeper 88. This initial release conveys the sense of having completed an initial mechanical key movement and approximates the aforementioned tacilte breakthrough sensation.

Figure 15:
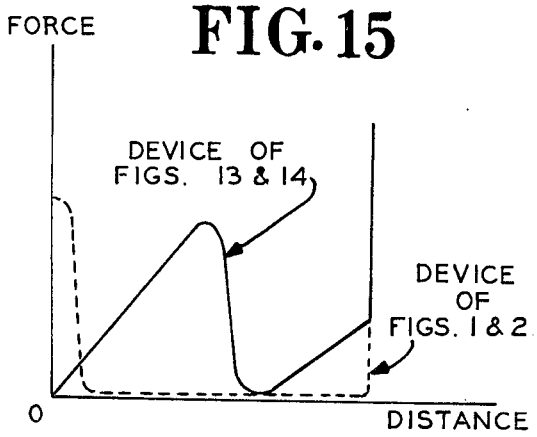
FIG. 15 is a chart showing the forces required to operate the push-buttons of FIGS. 13 and 14.
Figure 3:
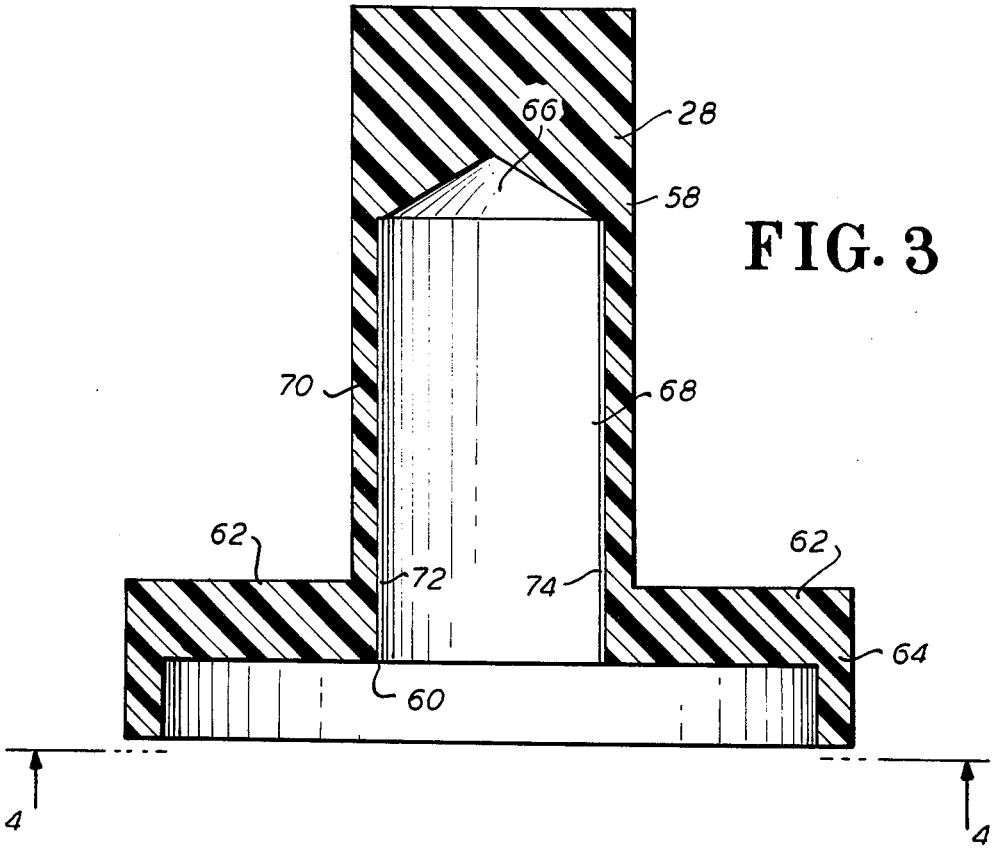
FIG. 3 is a sectional view of the top housing of the switch of FIG. 1 without other components therein.
Figure 4:
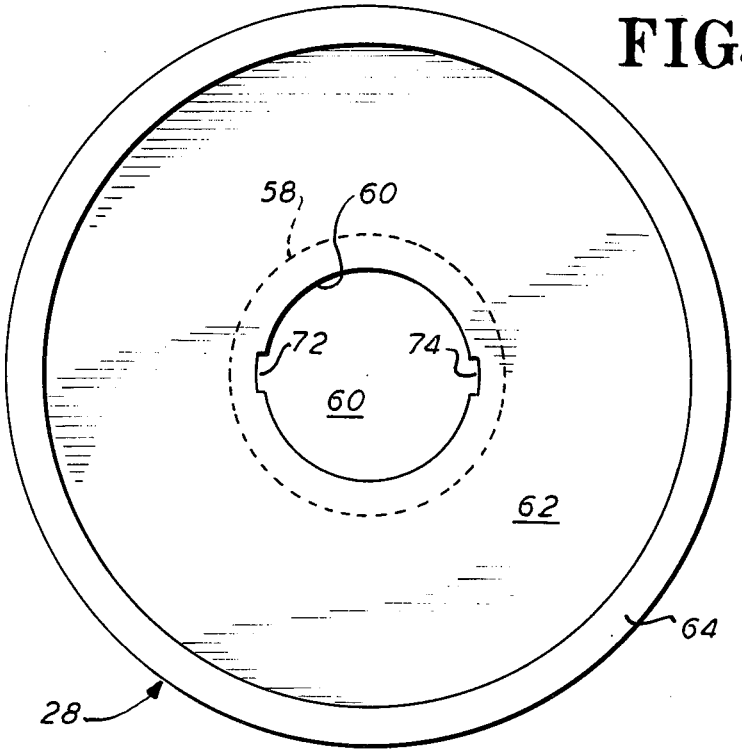
FIG. 4 is a bottom view of the top of the housing of FIG. 3 taken along lines 4—4.
Figure 6:
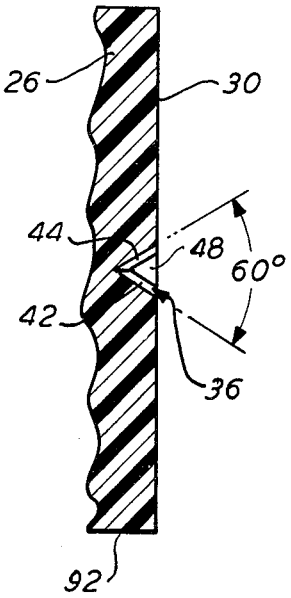
FIG. 6 is a sectional view of the base shown in FIG. 5 and taken along lines 6—6.

FIG. 15 shows the tactile breakthrough simulated by the devices of FIGS. 1 and 2 and 13 and 14. In both instances the user receives a 'release' sensation which conveys a tactile feeling of having completed the switch operation.

What is claimed is:

1. Push-button operating means for operating magnetic responsive switch mechanisms of the type which is manually operated, said push-button operating means comprising:

a. means for housing the magnetic switch mechanism;

b. a magnet surrounding at least a part of said housing means;

c. keeper means for holding said magnet in a quiescent position;

d. push-button means for moving, in response to the manual operation, said magnet from said keeper with a predetermined initial force, said initial force being greater than that force necessary to continued movement of said magnet with respect to said switch housing, thereby stimulating tactile breakthrough and operating the switch mechanism; and e. stop means for limiting the travel of said magnet.

2. Push-button operating means as recited in claim 1, wherein said push-button means comprises a push-button secured to said magnet and said magnet comprises a toroid; said housing being substantially cylindrical and said toroid being about said housing.

3. Push-button operating means as recited in claim 1, further comprising resilient means for resiliently holding said keeper means in a first position and permitting said keeper means to remain magnetically secured to said magnet during a portion of said movement and, upon said separation of said magnet from said keeper means, returning said keeper means toward the first position.

4. Push-button operating means as recited in claim 3, wherein said housing comprises a stem, said resilient means comprises a spring about said stem, said magnet comprises a toroidal magnet about said housing; said keeper means comprises a substantially magnetic responsive member movably secured to said stem and supported by said spring; said push-button comprises a hollow push-button surrounding said keeper, spring, and stem and engaging said magnet so that said keeper means is within said push-button such that upon said return of said keeper means by said spring, and said continued movement of said push-button, said keeper means engages said push-button and is further compressed against said spring.

5. A push-button operating means as recited in claim 1, wherein said stop means being so disposed such that said magnetic means being attracted back to said keeper means upon the removal of the force moving said push-button means.

6. A push-button operating means as recited in claim 4 wherein said stop means being so disposed such that said magnet being attracted back to said keeper upon the removal of said force moving the said push-button.

* * * * *